US007341262B2

(12) United States Patent
Liu

(10) Patent No.: US 7,341,262 B2
(45) Date of Patent: Mar. 11, 2008

(54) CUSHION FOR IN-LINE SKATE

(76) Inventor: Jack Liu, 5F-5, No. 10, Ching Shan Road, Taichung (TW)

( * ) Notice: Subject to any disclaimer, the term of this patent is extended or adjusted under 35 U.S.C. 154(b) by 0 days.

(21) Appl. No.: 11/306,407

(22) Filed: Dec. 27, 2005

(65) Prior Publication Data

US 2007/0145698 A1 Jun. 28, 2007

(51) Int. Cl.
*A63C 17/06* (2006.01)

(52) U.S. Cl. ..... 280/11.28; 280/11.221; 280/11.225; 280/11.206; 280/11.19; 280/7.13; 280/11.215

(58) Field of Classification Search ..... 280/11.28, 280/11.221–25, 11.206, 11.19, 7.13, 11.225, 280/11.215
See application file for complete search history.

(56) References Cited

U.S. PATENT DOCUMENTS 3,983,643 A * 10/1976 Schreyer et al. ..... 36/115
4,373,736 A * 2/1983 Stumbaugh ..... 280/11.233
5,135,244 A * 8/1992 Allison ..... 280/11.28
5,486,011 A * 1/1996 Nelson ..... 280/11.207
6,247,708 B1 * 6/2001 Hsu ..... 280/11.223
6,325,394 B1 * 12/2001 Svensson et al. ..... 280/11.216
6,412,791 B1 * 7/2002 Chu ..... 280/11.19
6,536,783 B2 * 3/2003 Gorza et al. ..... 280/11.204
6,644,673 B2 * 11/2003 Longino ..... 280/11.28

OTHER PUBLICATIONS

Taiwanese Patent Publication No. 331745, May 11, 1987, 4 pages.

* cited by examiner

*Primary Examiner*—Paul N. Dickson
*Assistant Examiner*—Cynthia F. Collado
(74) *Attorney, Agent, or Firm*—Alan Kamrath; Kamrath & Associates P.A.

(57) ABSTRACT

An in-line skate includes a frame and two rolling gears. Each of the rolling gears includes two levers pivotally connected to the frame, two casters each attached to related one of the levers, at least one first cushion provided between the levers and two second cushions each provided between related one of the levers and the frame.

17 Claims, 6 Drawing Sheets

CUSHION FOR IN-LINE SKATE

BACKGROUND OF INVENTION

1. Field of Invention

The present invention relates to an in-line skate and, more particularly, to a cushion for an in-line skate.

2. Related Prior Art

Disclosed in Taiwanese Patent Publication No. 331745 is an in-line skate including a frame 1 and two rolling gears 2. The frame 1 includes two walls 11 each including two pairs of apertures 111. Each of the rolling gears 2 includes two levers 21 and 24, two casters 22 and 25 and a spring 23. Each of the levers 21 and 24 includes an upper section, a lower section and a middle section. A pin 27 is driven into the middle section of the lever 21 through related apertures 111 of the walls 11. A pin 26 is driven in the middle section of the lever 24 through related apertures 111 of the walls 11. The spring 23 is compressed between the upper sections of the levers 21 and 24. The upper sections of the levers 21 and 24 can abut the bottom of the frame 1, thus limiting the maximum distance between the levers 21 and 24 and avoiding the escape of the spring 23. However, the lever 21 transfers impact to the frame 1 when the upper section of the former abuts the latter, particularly when the caster 22 bumps a rock. This means poor cushioning.

Therefore, the present invention is intended to obviate or at least alleviate the problems in the prior art.

SUMMARY OF INVENTION

According to the present invention, an in-line skate includes a frame and two rolling gears. Each of the rolling gears includes two levers pivotally connected to the frame, two casters each attached to related one of the levers, at least one first cushion provided between the levers and two second cushions each provided between related one of the levers and the frame.

An advantage of the in-line skate of the present invention is that the second cushions provide excellent cushioning.

Another advantage of the in-line skate of the present invention is that the first cushions prevent the casters from contacting each other, i.e., they prevent the casters from jamming each other.

Other advantages and features of the present invention will become apparent from the following description referring to the drawings.

BRIEF DESCRIPTION OF DRAWINGS

The present invention will be described via detailed illustration of embodiments referring to the drawings.

DETAILED DESCRIPTION OF PREFERRED EMBODIMENT

Figure 1:
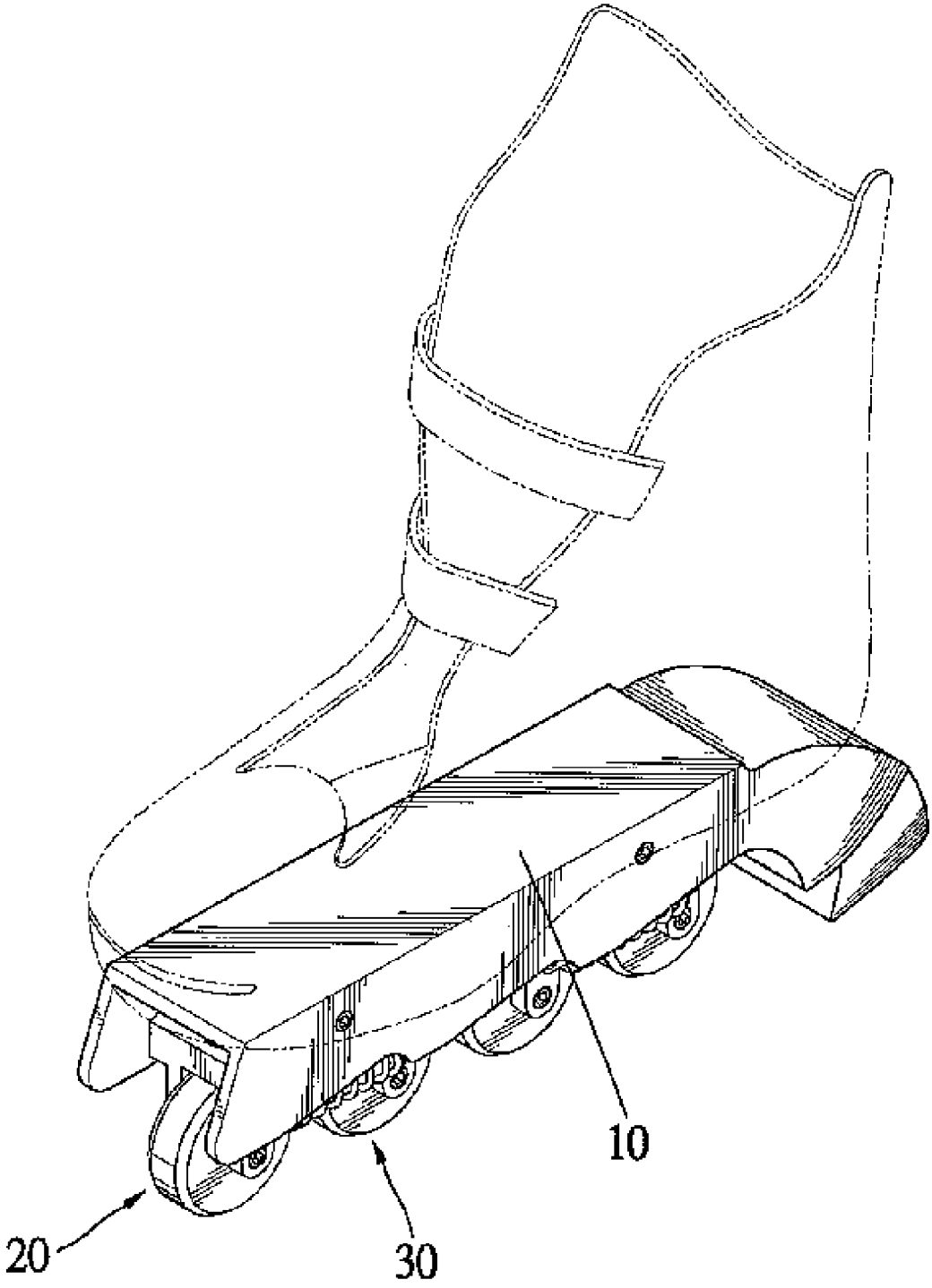
FIG. 1 is a perspective view of an in-line skate according to the preferred embodiment of the present invention.
Figure 2:
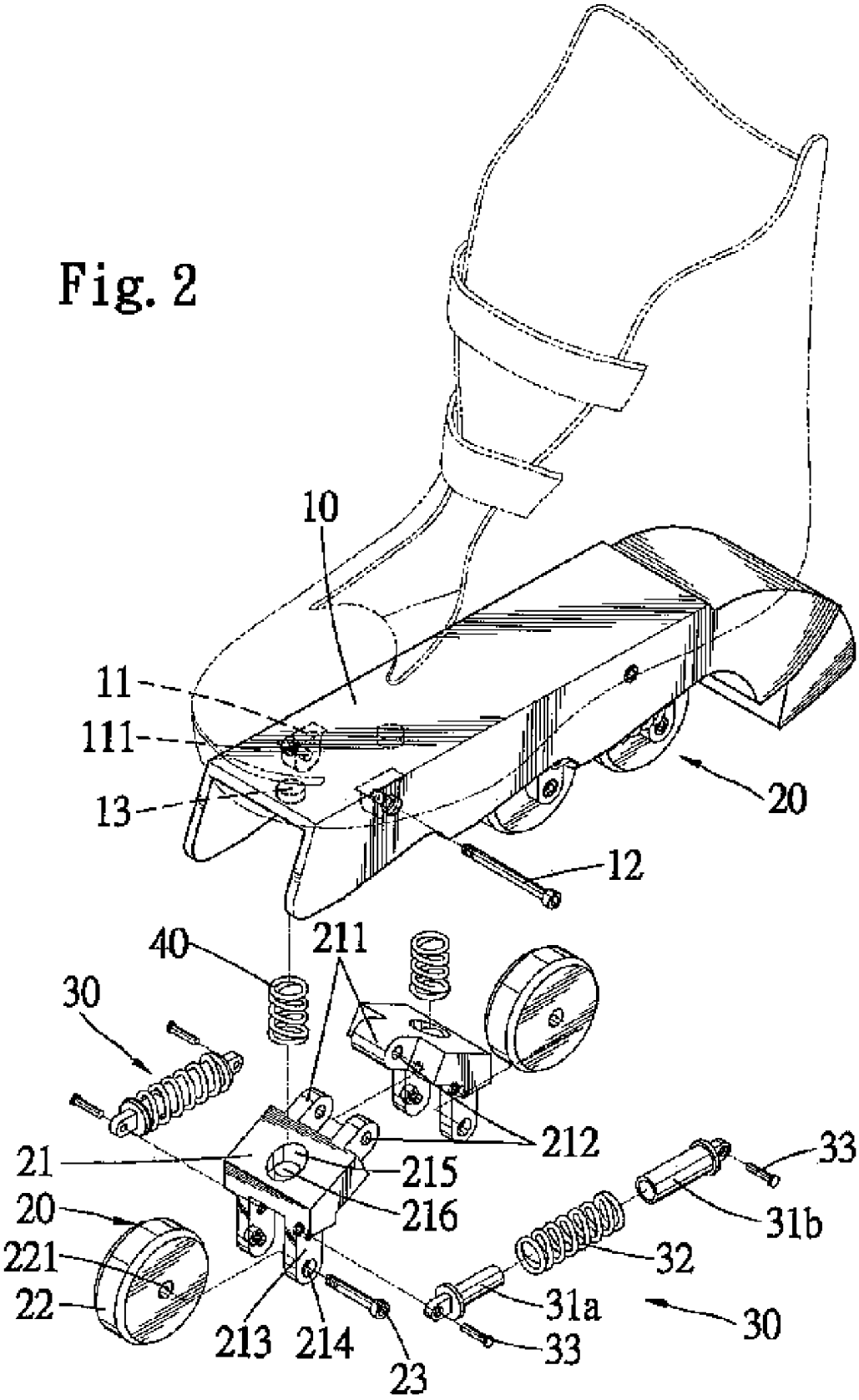
FIG. 2 is an exploded view of the in-line skate shown in FIG. 1.
Figure 3:
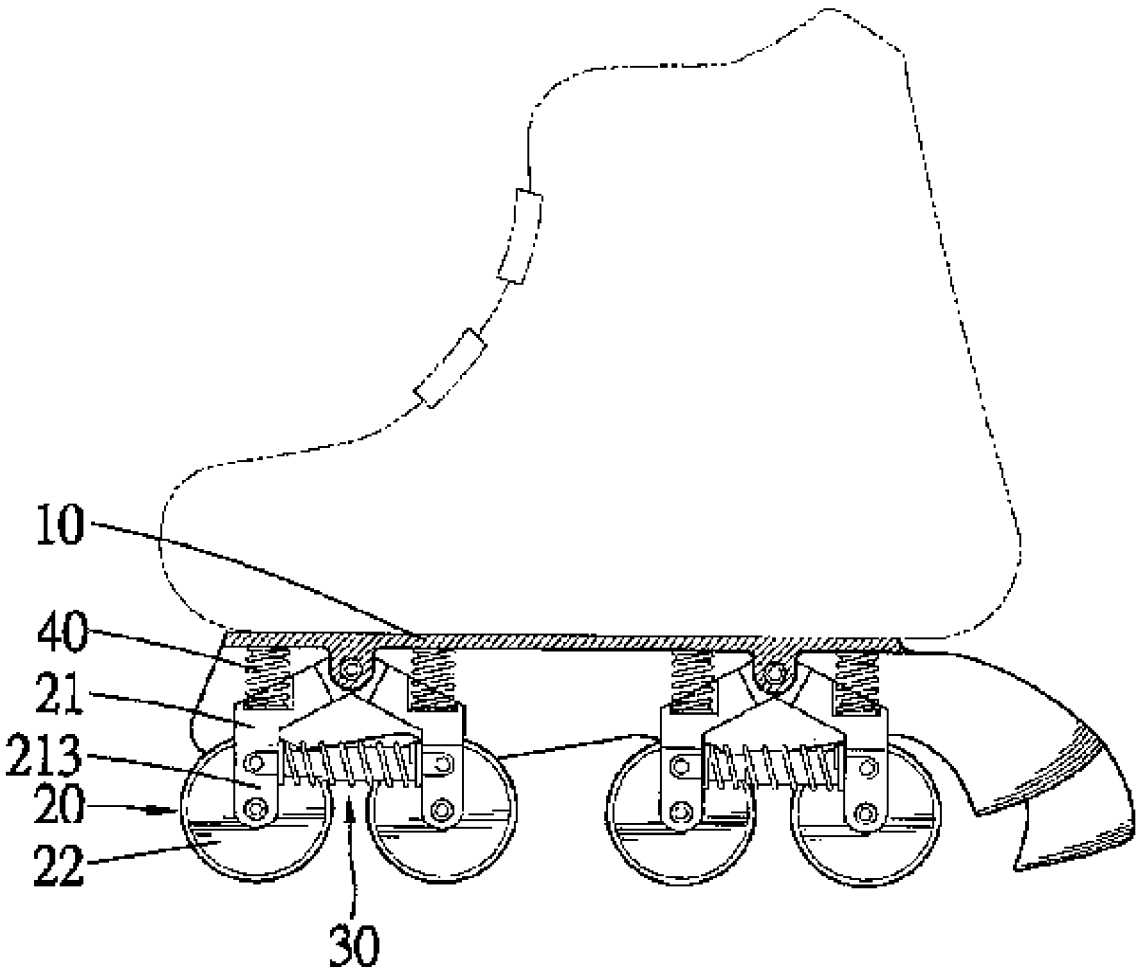
FIG. 3 is a cross-sectional view of the in-line skate shown in FIG. 1.

FIGS. 1 and 2 shows an in-line skate including a frame 10 and two rolling gears 20 pivotally connected to the frame 10. Each of the rolling gears 20 is provided with two first cushions 30 and two second cushions 40.

Referring to FIG. 2, the frame 10 includes two pairs of ears 11 on the bottom. Each pair of ears 11 is for the pivotal connection of related one of the rolling gears 20. Each ear 11 defines an aperture 111.

The following description will be focused on only one of the rolling gears 20 as well as only one pair of ears 11 for convenience. The rolling gear 20 includes two levers 21 pivotally connected to the pair of ears 11 and two casters 22 each attached to related one of the levers 21.

One of the levers 21 includes two ears 211. The remaining lever 21 includes only one ear 211 positioned between the ears 211 of the previous lever 21. Each ear 211 defines an aperture 212. A fastening device 12 is driven in the apertures 111 and 212 in order to pivotally connect the levers 21 to the pair of ears 11. The fastening device 12 includes a threaded bolt and a nut.

Each lever 21 includes a fork 213 for supporting related one of the casters 22. A fastening device 23 is driven in an aperture 214 defined in each of the prongs of the fork 213 of each lever 21 and an aperture 221 defined in related one of the casters 22. The fastening device 23 includes a threaded bolt and a nut.

Each lever 21 defines a recess 215. A stem 216 is formed on the floor of the recess 215.

Each first cushion 30 includes a rod or a plunger 31*a*, a cylinder 31*b* for receiving the plunger 31*a* and a helical spring 32 provided around and compressed between a portion of the plunder 31*a* and a portion of the cylinder 31*b*. The plunger 31*a* is connected to the fork 213 of one of the levers 21 by means of a pin 33. The cylinder 31*b* is connected to the fork 213 of the remaining lever 21 by means of a pin 33.

Each second cushion 40 is a helical spring compressed between related one of the levers 21 and the frame 10. Each second cushion 40 includes an end fit on a stem 13 formed on the bottom of the frame 10 and an opposite end fit in the recess 215 and fit around the stem 216 of related one of the levers 21.

Figure 4:
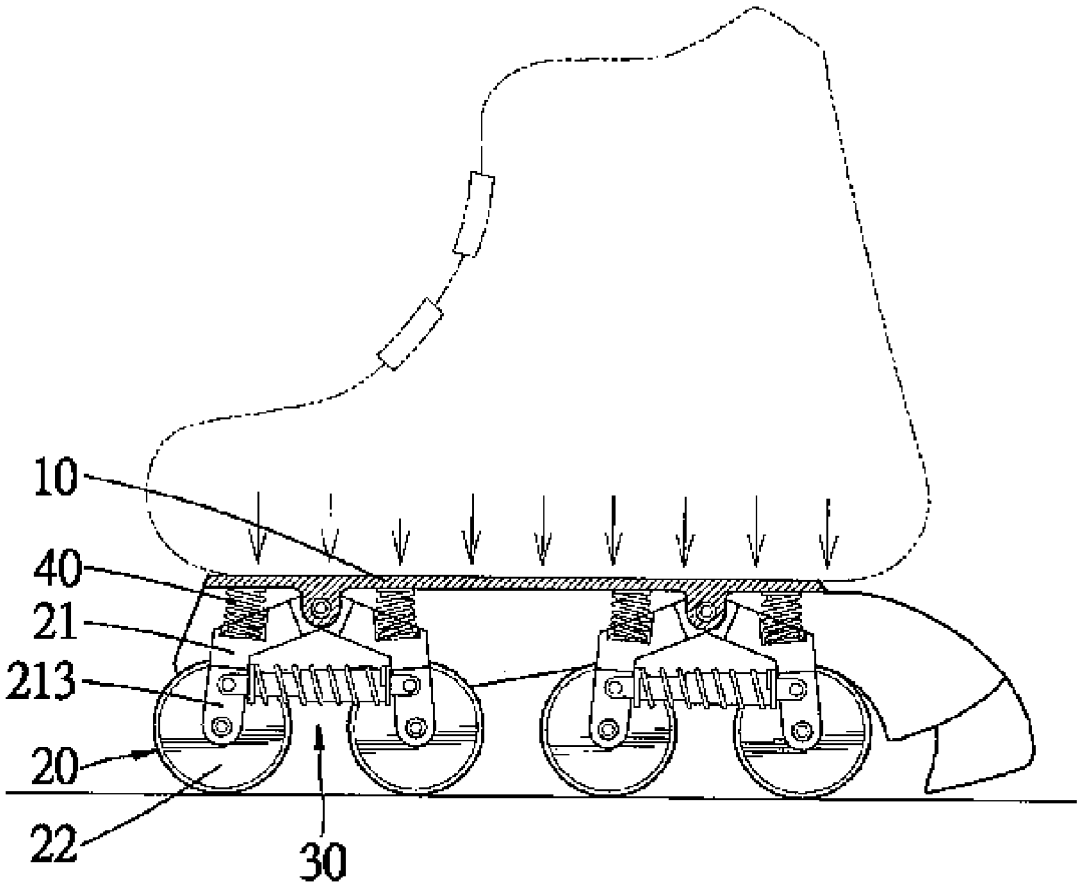
FIG. 4 is a cross-sectional view of the in-line skate in another position than shown in FIG. 3.

Referring to FIG. 4, the in-line skate is rolling on a flat surface. A load is exerted on the in-line skate. The levers 21 are opened. The second cushions 40 are compressed in order to provide cushioning between the levers 21 and the frame 10. Thus, in-line skate provides a soft and comfortable feel to a skater.

Figure 5:
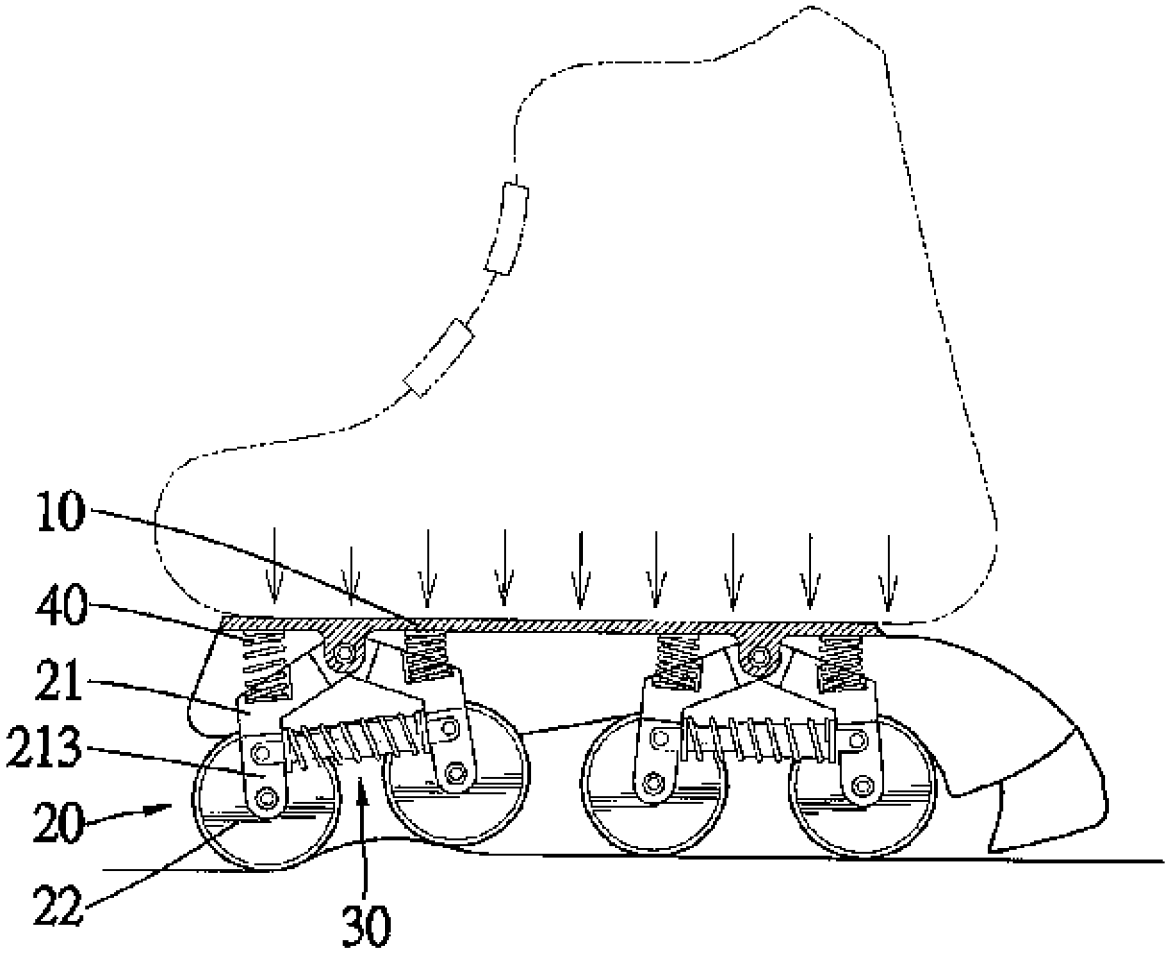
FIG. 5 is a cross-sectional view of the in-line skate of FIG. 4 rolling over a bump on the ground.
Figure 6:
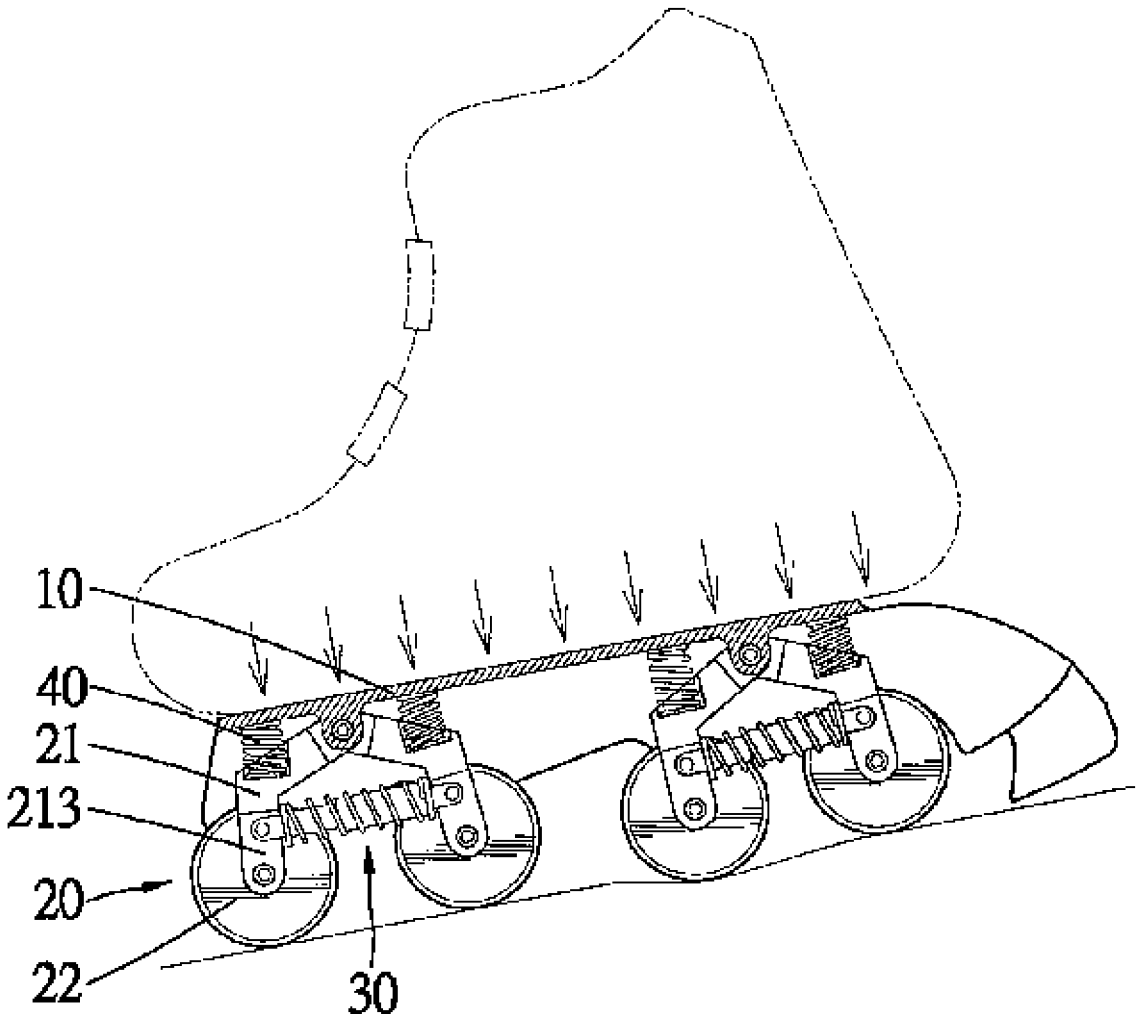
FIG. 6 is a cross-sectional view of the in-line skate of FIG. 4 rolling in a pit.

Referring to FIG. 5, the in-line skate is rolling on a bump. Referring to FIG. 6, the in-line skate is rolling in a pit. Based on the terrain on or in which the in-line skate rolls, one of second cushions 40 is compressed more than the other second cushion 40, and the levers 21 are pivoted to the front or back of the in-line skate. The first cushion 30 is used to prevent the casters 22 from getting too close to each other.

The in-line skate of the present invention exhibits two advantages. Firstly, the second cushions provide excellent cushioning. Secondly, the first cushions prevent the casters from contacting each other, i.e., they prevent the casters from jamming each other.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. An in-line skate comprising a frame and two rolling gears each comprising two levers pivotally connected to the frame, two casters each attached to related one of the levers, at least one first cushion extending between and in direct contact with the levers and two second cushions each extending between and in direct contact with corresponding one of the levers and the frame.

2. An in-line skate comprising a frame and two rolling gears each comprising two levers pivotally connected to the frame, two casters each attached to related one of the levers, at least one first cushion provided between and in direct contact with the levers and two second cushions each provided between and in direct contact with related one of the levers and the frame, wherein each of the levers comprises a recess for receiving an end of related one of the second cushions.

3. The in-line skate according to claim 2 wherein the second cushions are helical springs.

4. The in-line skate according to claim 3 wherein each of the levers comprises a stem formed on the floor of the recess in order to fit in the end of related one of the helical springs.

5. The in-line skate according to claim 3 wherein the frame comprises a stem formed on the bottom in order to fit in an opposite end of related one of the helical springs.

6. The in-line skate according to claim 1 wherein the first cushion comprises a helical spring.

7. An in-line skate comprising a frame and two rolling gears each comprising two levers pivotally connected to the frame, two casters each attached to related one of the levers, at least one first cushion provided between and in direct contact with the levers and two second cushions each provided between and in direct contact with related one of the levers and the frame, wherein the first cushion comprises a helical spring, wherein the first cushion comprises a rod connected to one of the levers and a cylinder connected to the other of the levers, and wherein the cylinder receives the rod, wherein the helical spring is provided around the cylinder and the rod.

8. The in-line skate according to claim 7 wherein the first cushion comprises a fastener for connecting the rod to the related one of the levers.

9. The in-line skate according to claim 7 wherein the first cushion comprises a fastener for connecting the cylinder to the related one of the levers.

10. The in-line skate according to claim 1 wherein the frame comprises two pairs of ears formed on the bottom, wherein each of the levers comprises at least one ear pivotally connected to related one of the pairs of ears.

11. The in-line skate according to claim 1 wherein each of the levers comprises a fork for supporting the related one of the casters.

12. The in-line skate according to claim 11 comprising a fastener for attaching the caster to the fork.

13. The in-line skate according to claim 12 wherein the fastener comprises a threaded bolt and a nut.

14. The in-line skate according to claim 1 comprising two first cushions.

15. The in-line skate according to claim 1 wherein the at least one first cushion pushes outwardly to separate the levers from contacting each other.

16. The in-line skate according to claim 15 wherein each second cushion includes a first end abutting a frame and a second end abutting the corresponding one of the levers, with each second cushion disposed perpendicular to an axis direction of the frame, and with the two levers biased by the two second cushions.

17. The in-line skate according to claim 1 wherein each second cushion includes a first end abutting a frame and a second end abutting the corresponding one of the levers, with each second cushion disposed perpendicular to an axis direction of the frame, and with the two levers biased by the two second cushions.

* * * * *